US005445383A

United States Patent [19]

Gleason, Jr.

[11] Patent Number: 5,445,383

[45] Date of Patent: Aug. 29, 1995

[54] PUTTING STROKE STABILIZING DEVICE

[76] Inventor: Richard F. Gleason, Jr., 67 Stadium Way, Allston, Mass. 02134

[21] Appl. No.: 185,116

[22] Filed: Jan. 21, 1994

[51] Int. Cl.[6] ..... A63B 69/36

[52] U.S. Cl. ..... 273/187.2; 273/189 R; 273/191 B; 273/DIG. 30

[58] Field of Search ..... 273/166, 189 A, 187.2, 273/189 R, 191 B, 187.5, DIG. 30

[56] References Cited

U.S. PATENT DOCUMENTS 2,943,859 7/1960 Koski et al. ..... 273/189 A 4,684,559 8/1987 Wasko ..... 273/166 X 4,752,075 6/1988 Bencriscutto ..... 273/166 X 5,116,057 5/1992 Mangiaracina ..... 273/166 X

*Primary Examiner*—George J. Marlo

[57] ABSTRACT

A putting stroke stabilizing device has a non-extensible strap with a first end containing a sleeve to receive a golf putter handle, and a second free end which is secured about the wrist of the golfer's first hand gripping the golf putter. The strap can include a hook-and-loop fastener arrangement, with the strap defining the cooperating loop element.

2 Claims, 2 Drawing Sheets

PUTTING STROKE STABILIZING DEVICE

BACKGROUND OF THE INVENTION

The invention relates to devices for stabilizing the putting stroke for golfers.

In golf, a putt is a precise stroke requiring high concentration for proper execution. It is known that, for a proper putting stroke, a golfer must keep his or her wrist firm and inflexible, so that the golfer's arms and hands maintain a straight line with the face of the putter blade squared to the target, thereby providing a pendulum-like swing. However, due to many control problems of the human grip, and also due to nervousness, fatigue or the lack of feel, it is often difficult for a golfer to maintain the proper control of direction and force of the putting stroke.

It has been known to assist a golfer's putting stroke control by use of devices that restrain the wrist action with the club, such as a metal frame through which wrists are placed when the device is slipped over the handle of the putter. However, these devices tend to be awkward, not designed for routine play, and suitable only for practice sessions. There also exist medical prostheses which attach to the golf club, for golfers with damaged or missing body parts.

SUMMARY OF THE INVENTION

According to one aspect of the invention, a golf putter stabilizing device includes a strap with a first end which receives a golf club handle, a second free end, and a securing means for securing the second free end about the wrist of a golfer's first hand placed about the golf club handle.

Preferred embodiments of this aspect of the invention can include one or more of the following features. The strap further includes a hook-and-loop fastener.

Preferred aspects of the method of the invention can include one or more of the following steps. The method further includes releasably attaching the second free end to the outer surface of the strap. Detachable graphic instructional elements may be placed at strategic positions upon the outside surface of the strap to further assist the golfer during the putting stroke.

Objectives of the invention include providing a support system to golfers for dependable use under the most tense conditions by removing highly variable wrist action from the putting stroke, and providing a device small enough to allow a golfer to wear the putter stabilizing strap device about the wrist continuously, just inserting and withdrawing the putter as necessary, without having to entirely remove the stabilizing strap device. The strap device can be used on either wrist, depending upon which wrist most needs restraint, and as best suits the player's stroking style. For example, the strap may be secured about the wrist of the first hand, as described above, and the second, free hand may grasp the putter handle below the first hand with overlapping digits. Both arms then supply the stroking force in a pendulum-like mode, having taken the wrist of the first out of the play action to aid the effect of both arms moving as one. The flared ends of the looped portion allow the putter to be re-introduced without having to unwrap the strap entirely.

These and other features and advantages of the invention will be seen from the following description of the preferred embodiments, and from the claims.

DESCRIPTION OF THE PREFERRED EMBODIMENTS

Figure 2:
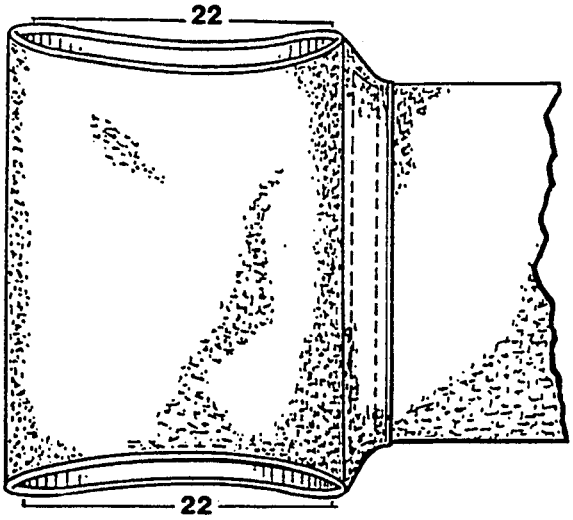
FIG. 2 is a perspective view of the golf putter stabilizing device of FIG. 1.
Figure 1:
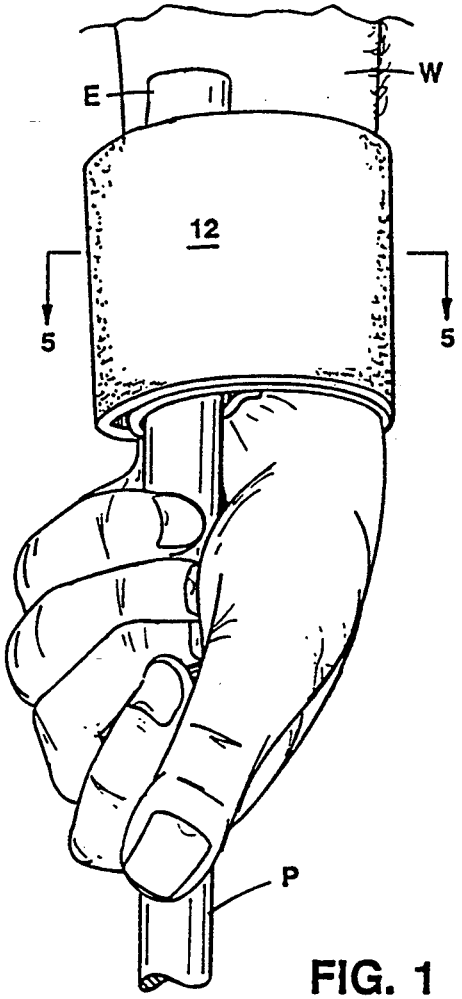
FIG. 1 is a perspective view of a golfer employing one embodiment of a putting stroke stabilizing device of the invention on left wrist. Right hand would grasp handle below the left during a putting stroke.
Figure 3:
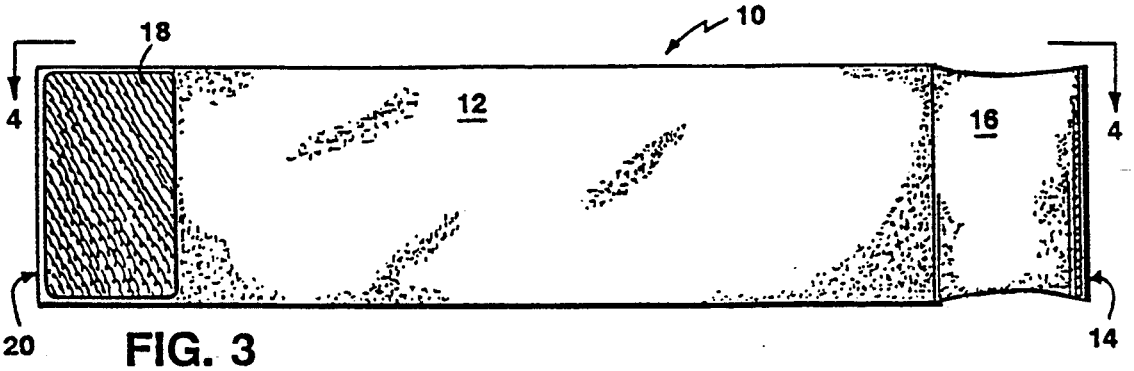
FIG. 3 is a plan view of the golf putter stabilizing device of FIG. 1.
Figure 4:
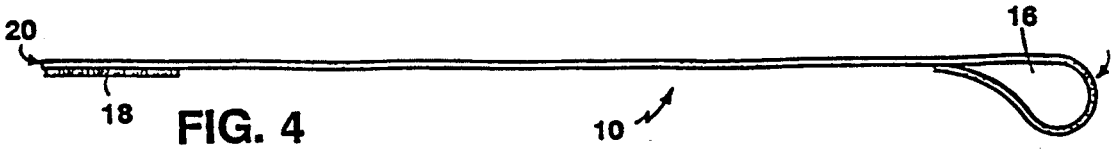
FIG. 4 is a top view of the golf putter stabilizing device taken at line 4—4 of FIG. 3.
Figure 5:
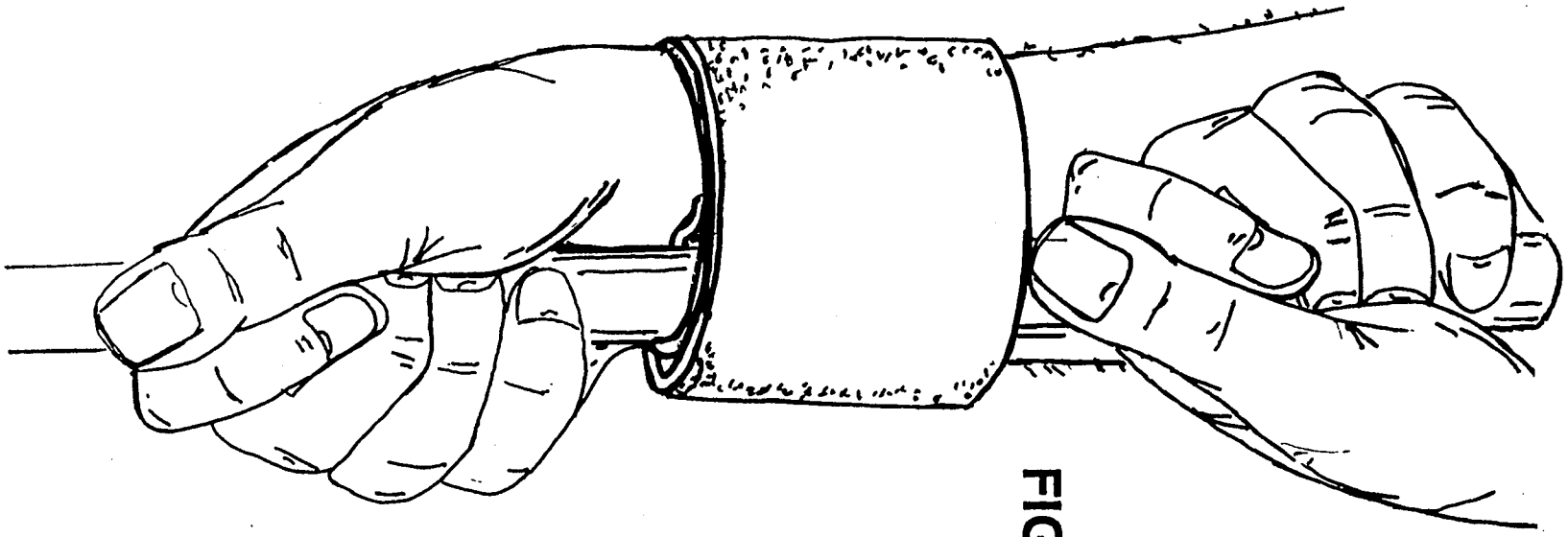
FIG. 5 is a perspective view of a golfer employing the putter stabilizing device inverted from FIG. 1 thereby locking the right wrist to the putter handle with the left hand gripping the putter handle above the right hand.

Referring to FIGS. 1 through 5, a golf putter stabilizing device 10 of the invention consists of an elongated strap 12 of a length adequate to extend about the wrist, W, of a golfer. A first end 14 of strap 10 defines a sleeve 16 sized to receive the handle, H, of the putter, P. Strap 10 can be formed of a non-extensible fabric material conducive for releasable engagement with a hook element 18 of a hook-and-loop type fastener arrangement associated with a second end 20 of strap 10. The strap width is usually about four inches, but may be wider, e.g. for comfortable use by larger-framed golfers.

Referring to FIG. 2, ends 22 of sleeve 16 can be flared, or curved, so that the putter handle can be reintroduced into the sleeve 16 more easily, thus allowing the putter to be introduced in sleeve 16 without the golfer having to entirely remove stabilizing strap 10. This aspect reduces the distraction of having to remove strap 10, thereby facilitating play.

For use during a putting stroke, the handle of a putter is inserted into sleeve 16 and stabilizing strap 10 is attached about the wrist of a golfer prior to putting, with sleeve 16 positioned at the inside of the wrist and strap body 12 extending about the wrist and secured by engagement of hook element 18 with a cooperating loop element of a hook-and-loop type fastener arrangement, the loop element being provided by the material of the outer surface of strap 10. The hook-and-loop type engagement of hook element 18 with strap body 12 provides complete adjustability of strap 10.

For convenience, a holder for strap 10 can be attached to the golfer's cart or golf club bag, in case the golfer wishes to remove stabilizing strap 10 during a break in play. A golf bag hook can be attached to a piece of hook-and-loop fastener material to receive the strap.

Other embodiments are within the following claims. For example, strap 10 could be made of leather or some other non-extensible material, and second free end 20 can be secured to strap 10 by a clasp or a buckle. If desired, strap 10 can also first be attached about the wrist of the golfer, with sleeve 16 positioned against the wrist, and then the handle of the putter can be inserted into sleeve 16.

What is claimed is:

1. A device for stabilizing the putting stroke of a golfer, comprising:

a non-extensible strap made of double sided loop material said strap having a first end defining a fixedly formed sleeve for receiving a golf club handle and a second free end, said strap having a length adequate to extend about a golfer's wrist; and hook means on said second free end for securing said second free end to said loop material and stabilizing the wrist of a golfer's first hand placed about the golf club handle.

2. The golf putter stabilizing device of claim 1, wherein said sleeve has flared openings at both ends.

* * * * *